US009156178B2

(12) United States Patent
Koch

(10) Patent No.: US 9,156,178 B2
(45) Date of Patent: Oct. 13, 2015

(54) SLICING MACHINE HAVING AN EXTERNAL CARRIAGE GUIDE

(75) Inventor: Nikolaus Koch, Geslingen (DE)

(73) Assignee: Bizerba GmbH & Co. KG, Balingen (DE)

( * ) Notice: Subject to any disclaimer, the term of this patent is extended or adjusted under 35 U.S.C. 154(b) by 279 days.

(21) Appl. No.: 13/639,253

(22) PCT Filed: Jun. 15, 2011

(86) PCT No.: PCT/EP2011/002944
§ 371 (c)(1),
(2), (4) Date: Oct. 4, 2012

(87) PCT Pub. No.: WO2011/157412
PCT Pub. Date: Dec. 22, 2011

(65) Prior Publication Data

US 2013/0025427 A1 Jan. 31, 2013

(30) Foreign Application Priority Data

Jun. 19, 2010 (DE) ..... 10 2010 024 422

(51) Int. Cl.

| | |
|---|---|
| ***B26D 1/143*** | (2006.01) |
| ***B26D 7/06*** | (2006.01) |
| *B26D 7/00* | (2006.01) |
| *B26D 7/22* | (2006.01) |

(52) U.S. Cl.
CPC ..... *B26D 7/0616* (2013.01); *B26D 7/225* (2013.01); *B26D 1/143* (2013.01); *B26D 7/00* (2013.01); *B26D 7/22* (2013.01); *B26D 2210/02* (2013.01); *Y10T 83/6608* (2015.04); *Y10T 83/95* (2015.04)

(58) Field of Classification Search
CPC ..... B26D 1/143; B26D 1/1435; B26D 1/12; B26D 1/14; B26D 1/141; B26D 7/06; B26D 7/0616; B26D 7/0608; B26D 7/01; Y10T 83/6608; Y10T 83/6609; Y10T 83/6611; Y10T 83/6612; Y10T 83/2096; Y10T 83/21; Y10T 83/2105; Y10T 83/2181; Y10T 83/222; Y10T 83/95; Y10T 83/932
USPC ..... 83/435.11–435.14, 111, 113, 115, 150, 83/167, 859, 932
See application file for complete search history.

(56) References Cited

U.S. PATENT DOCUMENTS

| | | | | |
|---|---|---|---|---|
| 4,397,206 | A * | 8/1983 | Czala | 83/399 |
| 7,832,317 | B2 * | 11/2010 | Zeeb et al. | 83/247 |
| 2003/0200854 | A1 * | 10/2003 | Graef et al. | 83/707 |
| 2006/0150791 | A1 * | 7/2006 | Chase et al. | 83/42 |
| 2010/0064872 | A1 * | 3/2010 | Gosis et al. | 83/717 |

FOREIGN PATENT DOCUMENTS

| | | |
|---|---|---|
| DE | 200 20 065 | 3/2001 |
| DE | 201 18 836 | 2/2002 |
| EP | 0 823 314 | 2/1998 |

* cited by examiner

*Primary Examiner* — Phong Nguyen
(74) *Attorney, Agent, or Firm* — Michael J. Striker

(57) ABSTRACT

An electrically operated slicing machine for cutting slices from product has cutting device with a circular knife mounted in a machine housing that rotates in a cutting plane (E; E') and a substantially flat support plate having a support surface for placement of the carriage carrying the product. The carriage is guided parallel to the cutting plane via a carriage base along a slide rail rigidly connected to the machine housing. The carriage base is supported to be movable relative to the machine housing via at least two support elements that are movably accommodated within a guide space.

7 Claims, 2 Drawing Sheets

SLICING MACHINE HAVING AN EXTERNAL CARRIAGE GUIDE

CROSS-REFERENCE TO A RELATED APPLICATION

The invention described and claimed hereinbelow is also described in German patent Application 10 2010 024 422.8 filed on Jun. 19, 2010. This German Patent Application, whose subject matter is incorporated here by reference, provides the basis for a claim of priority of invention under 35 U.S.C. 119(a)-(d).

BACKGROUND OF THE INVENTION

The invention relates to an electrically operated slicing machine for cutting slices from a product to be sliced, which is strand-shaped in particular and is preferably a foodstuff, comprising a cutting device, which includes a circular knife, which is mounted in a machine housing and rotates in a cutting plane, and comprising a substantially flat support plate having a support surface for placement of the carriage carrying the product to be sliced, wherein said carriage is guided parallel to the cutting plane via a carriage base along a slide rail rigidly connected to the machine housing, said carriage being displaceable parallel to the plane of the support plate, wherein the carriage base is supported via at least two support elements such that it is movable relative to the machine housing, and wherein the machine housing comprises a separating wall extending at least partially between the support plate and the carriage base, said separating wall partially enclosing, on the side thereof facing away from the support plate, a guide space in which the slide rail is disposed.

Such slicing machines are known from EP 0 823 314 A1, for example.

The product to be sliced, more particularly in automatically operated slicing machines for strand-shaped foodstuffs such as sausage, ham, salmon, cheese, etc., is moved against the cutting device with the aid of a feed device, usually in a direction perpendicular to the cutting plane in which usually one or more rotating circular knives rotate, in order to cut slices off of the conveyed product to be sliced. The cutting device is driven by an electric motor, which is fully enclosed by the machine housing as protection against splash water and contamination and as a mechanical safeguard against penetration from the outside.

In order to now separate the desired slice from the product to be sliced by way of the rotating knife, the product to be sliced, which is lying on the support surface of the support plate, is moved parallel to the cutting plane using a carriage and is fed toward the rotating knife blade until the rotating knife has cut completely through the product to be sliced and has cut the slice off of the product to be sliced. The support plate is usually rigidly connected to a carriage base, which extends downward from the support plate and is movably supported on a slide rail, which itself is rigidly connected to the machine housing.

Such a design is described in DE 200 20 065 U1, for example. In that case, the carriage base bears upwardly against the slide rail by way of an external carriage guide, wherein additional sliding surfaces for absorbing torques that occur are provided on the machine housing, on which said sliding surfaces the carriage base is situated in such a way that it slides from above.

Two-point support is provided in the slicing machine comprising an internal carriage guide, which is described in DF 201 18 836 U1, wherein the carriage guide is supported on a slide rail and, additionally, bears from above on a slide rail rigidly connected to the machine housing, via a roller.

Three-point support of the carriage base via a slide rail and via two roller-shaped support elements is depicted in the initially-mentioned document EP 0 823 314 A1. In this case, however, the carriage guide is disposed outside of the machine housing in an exposed manner and is therefore extremely susceptible to contamination and is not entirely suitable for use in such a hygienically sensitive manner such as in the food industry.

SUMMARY OF THE INVENTION

The problem addressed by the present invention is that of improving a slicing machine of the initially described type in question in a low-cost manner and using simple technical means in such a way that the machine can be cleaned in an improved manner and maintained in a simpler manner, and such that the carriage can be easily operated, while said machine remains as compact as possible and provides optimal operational safety.

This problem is solved by the invention in a manner that is as surprisingly simple as it is effective in that the at least two support elements are movably accommodated within the guide space and bear against the separating wall, wherein, in an operating state of the slicing machine, the first support element bears from below against the surface of a first separating wall section of the separating wall that faces away from the carriage, said separating wall extending underneath the support plate parallel to the plane of the support plate, and in that the separating wall comprises a second separating wall section that extends downwardly in a straight or slanted manner at an angle with respect to the first separating wall section, wherein the second support element bears laterally against the second separating wall section.

It is thereby ensured that the guide elements of the carriage are spatially separated from the dripping region of the product to be sliced - e.g., from dripping meat juices-and that the food region is separated from components having bearing grease or increased residue from wear using low-cost means due simply to the geometry of the arrangement. In addition, maintenance is simplified and it becomes possible to clean this region underneath the support plate, which is particularly susceptible to contamination. The outwardly lying carriage guide is easy to access and, therefore, easy to keep clean, thereby making it possible to minimize the effects of contamination on the quality of the product to be sliced or to even rule them out entirely by way of careful operation.

The divided design and the geometric arrangement of the separating wall, in particular, make it possible for a particularly compact design of the carriage base to be obtained. The geometry of the support upwardly against the first separating wall section and toward the side against the second separating wall section, in combination with the third support point on the slide rail, ensures a stable three-point support with the forces and torques balanced out in an optimal manner, more particularly in the maintenance position of the support plate, which is tilted with respect to the operating state.

The slicing machine according to the invention can be embodied as a vertical slicing machine or as a slanted slicing machine.

An embodiment of the slicing machine in which, in the operating state, the center of gravity of the support plate is located between the cutting plane and the first support element is particularly preferred. Said geometric distribution of the torques makes it easily possible for the carriage base to bear against the first separating wall section from below.

Even more effective protection of the carriage base region of the slicing machine against effects of contamination from the food region (and vice versa) and, therefore, improved cleanliness, are ensured via an embodiment of the invention in which the first separating wall section is angled downward on the edge in such a way that the first support element is covered toward the outside by the bent region of the first separating wall section.

Embodiments of the slicing machine according to the invention that are advantageous in terms of further improvement of cleanliness are those in which the second separating wall section, in combination with further parts of the machine housing and a removable base plate, forms an installation space that is sealed against splash water at the least and/or for accommodating drive parts and/or electronic elements of the slicing machine. As a result, protection of sensitive components against harmful external influences such as splash water or dust formation is ensured.

In a development of said embodiments that is preferred and easy to manufacture, a device is provided for adjusting the slice thickness of the product to be sliced, said device being actuatable via an adjusting device disposed in the installation space, wherein the passage region of the device through the machine housing should be sealed against splash water at the least.

Increased variability of the geometric configuration of the slicing machine according to the invention and of the operation thereof is provided by embodiments in which at least a portion of the support elements is attached at the carriage base with adjustable clearance from the separating wall.

Embodiments of the slicing machine according to the invention prove useful in practical application in which at least a portion of the support elements is in the form of rollers or sliding pins, which are typically commercially available.

Developments of said embodiments that characterized in that the rollers or sliding pins are adjustable via threads or eccentrics are advantageous in terms of handling.

In particularly preferred embodiments of the slicing machine according to the invention, the separating wall comprises a sliding surface or rail—which are preferably replaceable—in the region of at least a few support points of the support elements. The sliding surfaces can be constructed, in particular, of metal strips made of steel, brass, etc., which are fastened within the guide space and form a smooth sliding surface. Protection against wear of the separating wall is thereby obtained, which ultimately contributes to long stability. The replaceability ensures that any repairs that may become necessary can be easily performed.

In compact embodiments of the invention that are technically simple to manufacture, tracks can be installed or integrally formed directly in the separating wall in the region of at least a few support points of the support elements.

A further advantageous embodiment of the slicing machine according to the invention is characterized in that the slide rail is mounted or attached at both of the opposite end faces thereof in an end wall of the machine housing, and in that the two end walls cover the guide space enclosed by the separating wall on both end faces. Said measures ensure that the torques acting on the two separating wall sections are absorbed in an optimum manner and that cleanliness is improved further by minimizing the influences of contamination.

In stable developments of said embodiment, the separating wall also comprises strengthening ribs that extend into the guide space for absorbing the forces that occur during operation of the slicing machine according to the invention.

Finally, an embodiment of the slicing machine according to the invention, in which the support plate comprises a juice channel for fluid drainage in the support surface for the product to be sliced, is also preferable. The juice channel prevents meat juices from leaving the support surface in an uncontrolled manner during cutting of sausage or meat products by capturing the juices and diverting them away in a defined manner.

Further features and advantages of the invention will become apparent from the detailed description of embodiments of the invention presented below with reference to the figures in the drawing which shows the details that are essential to the invention. Further features and advantages of the invention will also become apparent from the claims. The individual features may be implemented individually, or they may be combined in any possible manner to form variants of the invention.

BRIEF DESCRIPTION OF THE DRAWINGS

Embodiments of the invention are depicted in the schematic drawing and are described in greater detail in the description that follows.

Shown are.

DETAILED DESCRIPTION OF THE INVENTION

Figure 1A:
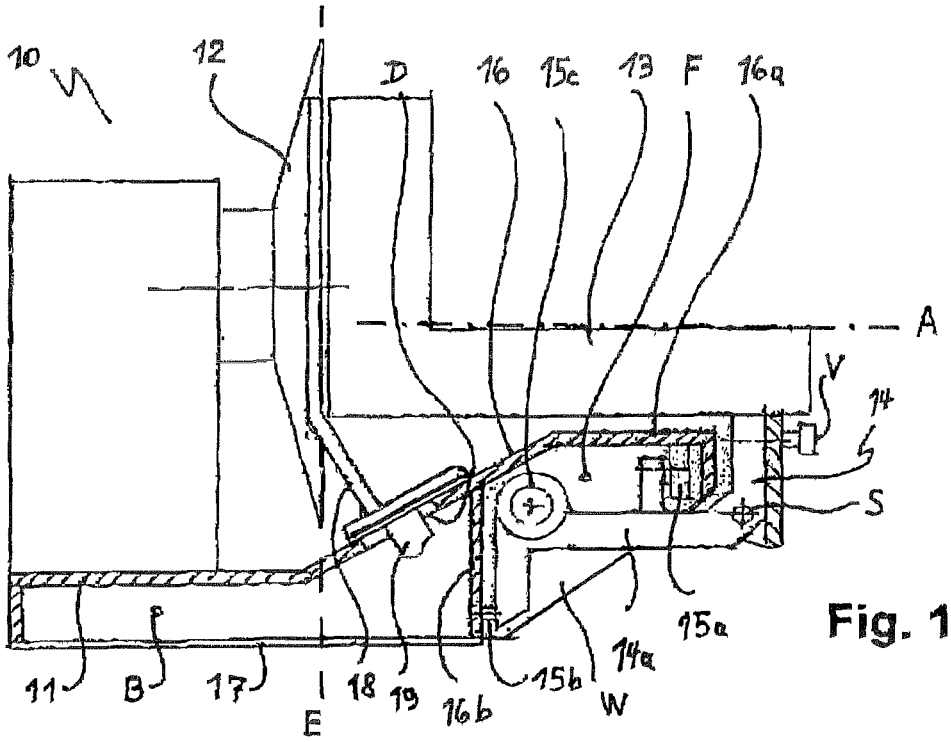
FIG. 1*a* shows a schematic vertical sectional view in a plane perpendicular to the cutting plane of the circular knife of a variant of the slicing machine according to the invention, which is designed as a vertical slicing machine, in the operating state with the support plate folded down horizontally.

The figures of the drawing show details of two embodiments (vertical slicing machine in FIGS. 1*a*, 1*b* and slanted slicing machine in FIGS. 2*a*, 2*b*) of the electrically operated slicing machine 10; 20 according to the invention, which is usually automatic, for cutting slices from product to be sliced, which is strand-shaped in particular and is preferably a foodstuff. The slicing machine 10; 20 comprises a cutting device, which includes a circular knife 12; 22, which is rotatably supported in a machine housing 11; 21 and rotates in a cutting plane E; E'. The slicing machine 10; 20 further comprises a substantially flat support plate 13; 23 having a support surface for placement of the product to be sliced, which is carried by a carriage 14; 24, which is guided parallel to the cutting plane E; E via a carriage base 14*a;* 24*a* along a slide rail 15*c;* 25*c* rigidly connected to the machine housing 11; 21, said carriage being displaceable parallel to the plane A; A' of the support plate 13; 23.

Figure 1B:
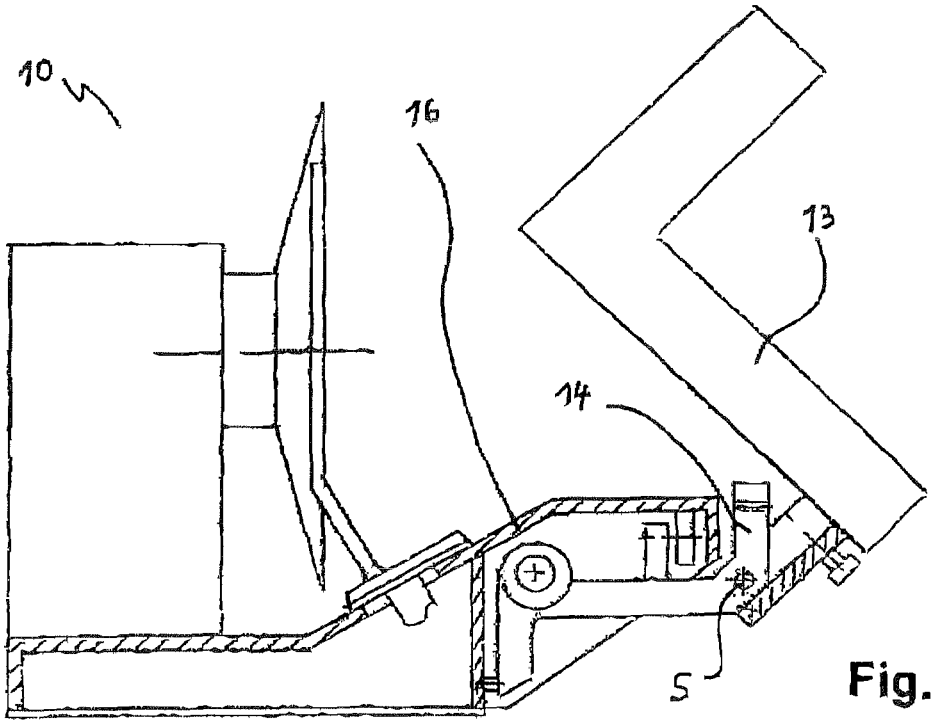
FIG. 1*b* shows the embodiment according to FIG. 1*a* with the support plate folded up.
Figure 2A:
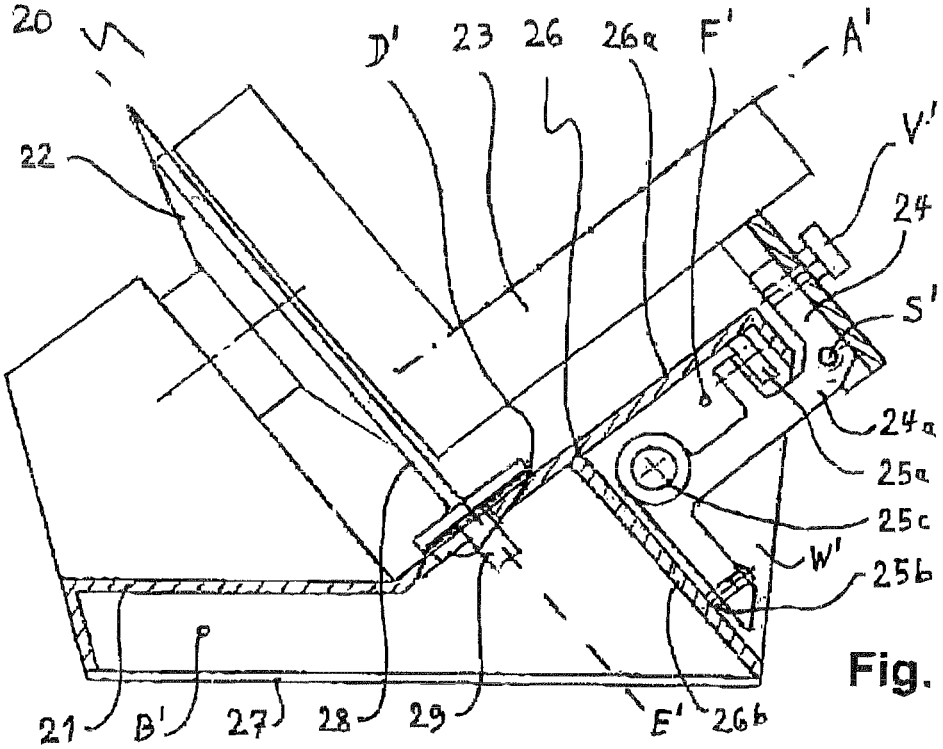
FIG. 2*a* shows a schematic vertical sectional view of a variant of the slicing machine according to the invention that is designed as a slanted slicing machine, in the operating state with the support plate folded down horizontally.
Figure 2B:
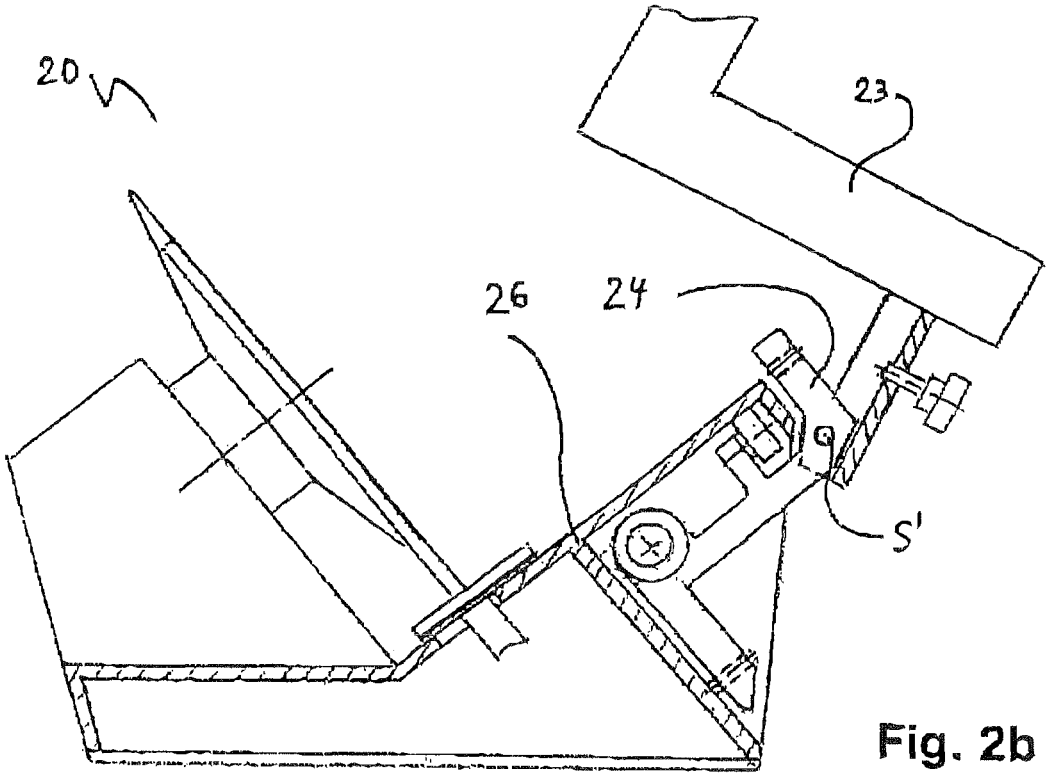
FIG. 2*b* shows the embodiment according to FIG. 2*a* with the support plate folded up.

As shown in FIG. 1*a*, the support plate 13 of the vertical slicing machine 10 shown is in a horizontal position, in which it is rigidly attached to the carriage 14 via a threaded connection, for example. The support plate 23 of the slanted slicing machine 20 shown in FIG. 2*a* is tilted at a slant relative to the horizontal in the operating state. In FIGS. 1*b* and 2*b*, said attachment is released and the support plate 13; 23 is tilted about a horizontal pivot axis S; S' with respect to the carriage 14; 24, in order to perform cleaning or maintenance, for example.

Alternatively, in embodiments not depicted in the drawing, the slicing machine according to the invention can also be in the form of a slanted slicing machine having a different tilt angle, wherein the support plate is also pivotable in that case.

To fix the support plate 13; 23 in the non-swiveled position in the operating state of the slicing machine 10; 20 according to the invention, closing elements V; V' such as threaded screws or bolts are provided.

The carriage base 14*a;* 24*a* is supported via at least two support elements 15*a*, 15*b;* 25*a*, 25*b* in such a way that it is movable relative to the machine housing 11; 21, which comprises a separating wall 16; 26, which extends at least partially between the support plate 13; 23 and the carriage base 14*a;* 24*a* and encloses, on the side thereof facing away from the support plate 13; 23, a guide space F; F' in which the slide rail 15*c;* 25*c* is also disposed.

According to the invention, the support elements 15*a*, 15*b;* 25*a*, 25*b* are movably accommodated within the guide space F; F' and are supported against the surface of the separating wall 16; 26 facing away from the carriage 14; 24, wherein, in the operating state of the slicing machine 10; 20, the first support element 15*a;* 25*a* bears from below against the surface—facing away from the carriage 14; 24—of a first separating wall section 16*a;* 26*a* of the separating wall 16; 26, which extends underneath the support plate 13; 23 parallel to the plane A; A' of the support plate 13; 23, and wherein the separating wail 16; 26 comprises a second separating wall section 16*b;* 26*b*, which extends downwardly in a straight (FIGS. 1*a*, 1*b*) or slanted (FIGS. 2*a*, 2*b*) manner at an angle with respect to the first separating wall section (16*a;* 26*a*), wherein the second support element 15*b;* 25*b* bear laterally against the second separating wall section 16*b;* 26*b*.

In the operating state of the slicing machine 10; 20 depicted in FIGS. 1*a* and 2*a*, the center of gravity of the support plate 13; 23 is located between the cutting plane E; E' and the first support element 15*a;* 25*a*.

The first separating wall section 16*a;* 26*a* in each case is angled downward on the edge in such a way (straight or slanted) that the first support element 15*a;* 25*a* is covered toward the outside by the bent region of the first separating wall section 16*a;* 26*a*.

The second separating wall section 16*b;* 26*b*, in combination with further parts of the machine housing 11; 21 and a removable base plate 17; 27, forms an installation space B; B', which is sealed against splash water at the least, for accommodating drive parts and/or electronic elements of the slicing machine 10; 20.

A device 18; 28 for adjusting the slice thickness of the product to be sliced is typically provided, said device being actuatable via an adjusting device 19; 29 disposed in the installation space B; B', wherein the passage region of the device 18; 28 through the machine housing 11; 21 is sealed against splash water at the least. Sealing elements D; D', which are depicted merely schematically in the drawing, can be provided for this purpose.

The support elements 15*a*, 15*b;* 25*a*, 25*b* are preferably attached at the carriage base 14*a;* 24*a* in such a manner that the clearance thereof from the separating wall 16; 26 can be adjusted. In embodiments of the invention they can be designed as rollers or sliding pins, which are adjustable via threads or eccentrics in particular. In addition, the separating wall 16; 26 can comprise a preferably replaceable sliding support or rail in the region of the support points of the support elements 15*a*, 15*b;* 25*a*, 25*b*, or tracks can be installed or integrally formed in the separating wall 16; 26. Said elements are not depicted separately in the drawing.

The figures of the drawing merely indicate that the slide rail 15*c;* 25*c* can be mounted or attached at both of the opposite end faces thereof in an end wall W; W' of the machine housing 11; 21, wherein the two end walls cover the guide space F; F' enclosed by the separating wall 16; 26 on both end faces. Strengthening ribs, which protrude from the separating wall 16; 26 and extend into the guide space F; F', are not depicted separately in the drawing.

Embodiments are also not shown in which the support plate 13; 23 comprises a juice channel for fluid drainage in the support surface for the product to be sliced.

What is claimed is:

1. An electrically operated slicing machine for cutting slices from product, comprising;

a machine housing;

a cutting device, which includes a circular knife mounted in the machine housing to rotate in a cutting plane;

a carriage comprising a carriage base and a support plate, wherein the support plate is substantially flat and includes a support surface for carrying a product to be sliced;

a slide rail rigidly connected to the machine housing for guiding the carriage via the carriage base such that the carriage is displaceable parallel to the cutting plane and parallel to a plane of the substantially flat support plate;

wherein the carriage base is movable relative to the machine housing and is supported via at least a first support element and a second support element;

wherein the first support element and the second support element are attached to the carriage base;

wherein the machine housing comprises a separating wall formed of a first separating wall section and a second separating wall section;

wherein the first separating wall section extends at least partially between the support plate and the carriage base, partially enclosing a guide space in which the sliding rail is disposed;

wherein the second separating wall section extends downwardly in a straight or slanted manner at an angle with respect to the first separating wall section;

wherein the first support element and the second support element are movably accommodated within the guide space and bear against the separating wall;

wherein, in an operating state of the slicing machine, the first support element bears against a first surface of the first separating wall section, the first surface of the first separating wall section facing the guide space; and wherein the second support element bears laterally against the second separating wall section.

2. The slicing machine according to claim 1 wherein a center of gravity of the support plate is located between the cutting plane (E; E') and the first support element.

3. The slicing machine according to claim 1 wherein the first separating wall section includes a rearwards portion that extends at an acute angle downwards to the second separating wall section and a forwards section that is angled downward for an extent in an arrangement whereby the first support element is covered toward an outside.

4. The slicing machine according to claim 1, wherein the second separating wall section, in combination with the machine housing and a removable base plate, forms an installation space (B; B') for accommodating drive parts, and electronic elements of the slicing machine said installation space sealed against splash water.

5. The slicing machine according to claim 4, further comprising a device for adjusting a the slice thickness of the product that is actuatable via an adjusting device disposed in the installation space, wherein a passage region of the device through the machine housing is sealed against splash water.

6. The slicing machine according to claim 1, wherein the first and the second support elements comprise rollers or sliding pins.

7. The slicing machine according to claim 1 wherein the slide rail is mounted or attached at both of opposite end faces thereof in an end wall of the machine housing, and wherein the two end walls cover the guide space (F; F') enclosed by the separating wall.

* * * * *